United States Patent [19]

Hashizume et al.

[11] Patent Number: 5,064,611

[45] Date of Patent: Nov. 12, 1991

[54] PROCESS FOR PRODUCING COPPER ALLOY

[75] Inventors: Kimio Hashizume; Keizo Kitakaze; Takefumi Itou, all of Amagasaki, Japan

[73] Assignee: Mitsubishi Denki Kabushiki Kaisha, Tokyo, Japan

[21] Appl. No.: 642,353

[22] Filed: Jan. 17, 1991

[30] Foreign Application Priority Data

Apr. 26, 1990 [JP] Japan ..... 2-108641

[51] Int. Cl.[5] ..... C22C 1/00; C22C 9/04; C22C 9/06; C22C 9/10

[52] U.S. Cl. ..... 420/481; 420/485

[58] Field of Search ..... 420/481, 485

[56] References Cited

U.S. PATENT DOCUMENTS 4,209,570 6/1980 DeCristofaro et al. ..... 420/485
4,253,870 3/1981 DeCristofaro et al. ..... 420/485

FOREIGN PATENT DOCUMENTS 58-18981 4/1983 Japan .
58-104148 6/1983 Japan .

*Primary Examiner*—R. Dean
*Assistant Examiner*—David W. Schumaker
*Attorney, Agent, or Firm*—Oblon, Spivak, McClelland, Maier & Neustadt

[57] ABSTRACT

An improved method for producing a copper alloy, wherein a molten metal consisting essentially of 1.0 to 8% by weight of Ni, 0.1 to 0.8% by weight of P, 0.06 to 1.0% by weight of Si, and a remainder of Cu and unavoidable impurities (or a molten metal consisting essentially of 1.0 to 8% by weight of Ni, 0.1 to 0.8% by weight of P, 0.06 to 1.0% by weight of Si, 0.03 to 0.5% by weight of Zn, and a remainder of Cu and unavoidable impurities) is quenched to solidify, at a cooling rate in the range from $10^{2°}$ C./sec. to $10^{5°}$ C./sec., and continuously cooling in succession said solidified metal to a normal temperature, to cause an intermetallic compound of Ni-P and Ni-Si to be finely and uniformly dispersed into the matrix material.

6 Claims, 1 Drawing Sheet

PROCESS FOR PRODUCING COPPER ALLOY

BACKGROUND OF THE INVENTION

1. Field of the Invention

This invention relates to a process for producing a copper alloy, and, more particularly, it is concerned with a process, by which Cu-Ni-P-Si alloy and Cu-Ni-P-Si-Zn alloy which are most suitable copper alloy as a lead frame material for integrated circuits, connectors, relays, and so on for electronic apparatuses and appliances.

2. Discussion of Background

As a method for producing an ingot of copper alloy for electronic apparatuses and appliances, there has so far been practiced generally the continuous casting by means of a horizontal continuous casting device. FIG. 2 of the accompanying drawing is a cross-sectional view of the conventional horizontal continuous casting device as disclosed in, for example, Japanese Unexamined Patent Publication No. 39639/1983. In this figure of drawing, a reference numeral 1 designates a melt of a metal which has been melted in a melting furnace (not shown in the drawing) by electric power such as, for example, high frequency electric power; a numeral 2 refers to a holding furnace to retain therein the melt 1 at a certain definite temperature level and in a required quantity; a numeral 3 refers to a graphite mold which is fixedly provided at the lower end part of the holding furnace 2; a reference numeral 4 denotes a water-cooling jacket which is provided in a manner to surround the graphite mold 3; and a reference numeral 5 represents traction rollers for drawing an ingot 6 obtained by cooling and solidifying the melt 1.

In the casting device of the above-mentioned construction, the melt 1 which is collected in the holding furnace 2 is poured into the graphite mold 3 and solidified under the cooling action of the cooling water flowing in the water path in the interior of the water-cooling jacket 3, and the thus solidified metal is discharged from the casting mold 3 in the form of an ingot 6. In this case, the ingot 6 is drawn out by the traction rollers 5 either continuously or intermittently, whereby a continuous web of the ingot 6 is obtained. After this, rolling and heating of the ingot are repeated to finish the ingot into a thin plate material of a predetermined size.

In the case of casting a melt of an alloy of a type which is strengthened, in accordance with the above-mentioned casting method, by dispersing and depositing an intermetallic compound into a matrix, the ingot is in the state of its containing therein the intermetallic compound which is non-uniformly dispersed in the matrix, the intermetallic compound to be formed in the course of its solidification having a coarse and irregular grain size, on account of a relatively low cooling rate of 10° C./min. or below. With the ingot of such state, the size and the dispersed state of the intermetallic compound is not substantially changed from its state as cast, even when it is finished into the ultimate thin plate product through the process steps of heating and rolling to take place after the casting. As the result, while excellent mechanical strength and favorable electrical conductivity can be obtained with the thin plate product, it is considerably inferior in its shapability with the consequent problem of its being inapplicable to the field of electrical connectors where the stringent shaping capability is demanded.

Further, the presence of the intermetallic compound in coarse grain size leads to non-uniform etching, blistering and peeling of the plated portion, and moreover poor bonding in the bare bonding (i.e., connection of a copper type lead frame material and a semiconductor chip with a wire of Au, Al or Cu), which possibly brings about decrease in reliability of the alloy for the electronic parts.

SUMMARY OF THE INVENTION

The present invention has been made with a view to solving the conventional problems as described in the foregoing, and aims at providing a method which is capable of producing Cu-Ni-P-Si alloy or Cu-Ni-P-Si-Zn alloy having a favorable shaping capability and a high operating reliability, by producing an ingot with an intermetallic compound to be formed at the time of solidification in the course of the casting being dispersed finely and uniformly in the matrix.

That is to say, according to the present invention, in its general aspect, there is provided a method for producing a copper alloy, which comprises steps of: quenching and solidifying, at a cooling rate in the range of from $10^{2}$° C./sec. to $10^{5}$° C./sec., a molten metal consisting essentially of 1.0 to 8% of Ni, 0.1 to 0.8% of P, 0.06 to 1.0% of Si, and a remainder of Cu and unavoidable impurities (% being by weight), or a molten metal consisting essentially of 1.0 to 8% of Ni, 0.1 to 0.8% of P, 0.06 to 1.0% of Si, 0.03 to 0.5% of Zn, and a remainder of Cu and unavoidable impurities (% being by weight); and continuously cooling in succession said solidified metal to normal temperature (room temperature) to cause an intermetallic compound of Ni-P and Ni-Si to be finely and uniformly dispersed into the matrix material.

The foregoing object, other objects as well as details of the process for producing the copper alloy according to the present invention will become more apparent and understandable from the following detailed description thereof, when read in conjunction with the accompanying drawing which illustrates a casting device to effect a preferred example of the process of the present invention.

BRIEF DESCRIPTION OF THE ACCOMPANYING DRAWINGS

In the drawing:

FIG. 1 is a schematic diagram showing a general concept of a double roll type metal quenching and casting apparatus for the purpose of practicing the process of the present invention; and FIG. 2 is a cross-sectional view of a conventional horizontal continuous casting apparatus.

DETAILED DESCRIPTION OF THE PREFERRED EMBODIMENT

Figure 1:
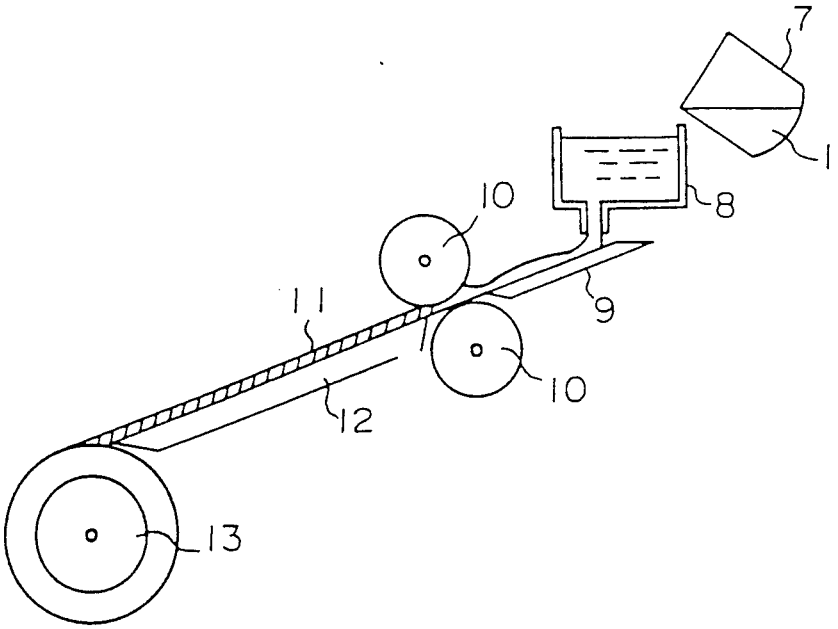
Figure 2:
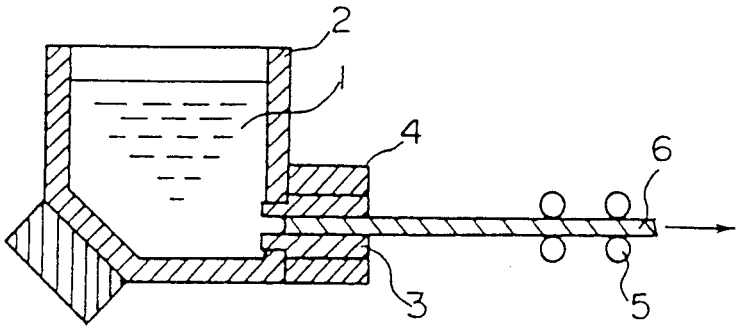

In the process for producing copper alloy according to the present invention, the cooling rate is limited to a range which is over $10^{2}$° C./sec., but below $10^{5}$° C./sec., for the following reasons. That is to say, as the result of various experiments, it was found out that, on the one hand, with the cooling rate of below $10^{2}$° C./sec., the effect of micronization of the intermetallic compound such as Ni-P and Ni-Si is small, and there can be obtained no state of its uniform dispersion into the matrix, and, on the other hand, with the cooling rate of over $10^{5}$° C./sec., the plate thickness of the ingot becomes too thin to be practically used.

In the following, explanations will be given as to the reason for adding the alloy components to constitute the copper alloy to be used for the electronic apparatuses and appliances, as well as the reason for limiting the compositional range of such alloy components.

Ni, P and Si should be in such compositional ranges that can efficiently produce the intermetallic compounds such as $Ni_5P_2$, $Ni_2Si$, and so on, increase the mechanical strength of the alloy, and be least in the decrease in the electrical conductivity of the alloy. The lower limit of Ni is set to be 1.0%. Below this lower limit, less intermetallic compound is produced and less improvement in the mechanical strength of the alloy is attained. The upper limit of Ni, on the other hand, is 8%. Over this upper limit, no effect can be seen in the improvement of the mechanical strength, in spite of increase in its mixing quantity, and, moreover, the processability of the alloy tends to be deteriorated, its electrical conductivity tends to become lower, and heat-resistance of solder-plating tends to be deteriorated. In order to effectively produce the intermetallic compounds of Ni and P as well as Ni and Si, the weight ratio between Ni and P should be about 5:1 and the weight ratio between Ni and Si should be about 4:1, and under these conditions, the mechanical strength and the electrical conductivity of the alloy attain their maximum level, which ratio substantially corresponds to those of $Ni_5P_2$ and $Ni_2Si$. Consequently, the quantities of P and Si are set on the basis of this weight ratio.

In the case of adding Zn, there can be seen an effect such that Zn suppresses decrease in reliability of the alloy to be used for electronic parts, due to peeling of a soldered layer under a high temperature circumstance after soldering or solder-plating of the copper alloy. For this purpose, the content of Zn is set to be in a range of from 0.03% as its minimum required quantity to 0.5% as its upper limit from the point of its stress corrosion property.

At the time of casting the Cu-Ni-P-Si alloy or the Cu-Ni-P-Si-Zn alloy according to the present invention, the molten metal is quenched to solidify at a cooling rate in the range from $10^{2}$° C./sec. to $10^{5}$° C./sec., and then the solidified metal is continuously cooled in succession to a normal temperature to thereby cause the intermetallic compound of Ni-P and Ni-Si to be finely and uniformly dispersed into the matrix. In this way, the shaping capability (shapability) of the alloy can be remarkably improved, and the reliability of the electronic parts made of this copper alloy, such as heat-resistance of the plating, etc. can be increased.

With a view to enabling those persons skilled in the art to put the present invention into practice, explanations will be given in the following as to the device for producing the copper alloy according to the present invention.

EXAMPLE

Referring to FIG. 1 showing a schematic diagram for general conception of a double roll type metal quenching and casting device to practice the present invention, a reference numeral 7 designates a ladle for pouring the melt 1 of a metal melted by a melting furnace (not shown in the drawing); a reference numeral 8 denotes a holding furnace to keep the melt 1 therein; a numeral 9 refers to a gutter to guide the melt 1 flowing out of the holding furnace 8 to a predetermined location, the holding furnace being provided with a heat insulating means to prevent the melt 1 from solidifying; a reference numeral 10 represents cooling rolls which are disposed one upon the other with a variable space interval between them, and are cooled with water, rotational speed of these rolls being also made adjustable arbitrarily; a numeral 11 refers to an ingot obtained by solidification of the melt 1 after its passage through the above-mentioned cooling rolls 10, the ingot being a thin plate intended by the present invention; and a numeral 12 refers to a guide to lead the thin plate ingot to a take-up roller 13.

In the metal quenching and casting device of the above-described construction, the melt 1 is supplied from the melt-holding furnace 8 into a space gap between the cooling rollers 10 by way of the gutter 9, the melt 1 being instantaneously solidified at the time of its passage through the cooling rollers 10 to be formed into the thin plate ingot 11. The thus obtained thin plate ingot 11 slides on and along the guide 12 to be sent to the takeup roller 13, onto which it is continuously wound.

With a view to verifying the effect of the present invention, there were produced molten metals from specimens Nos. 2, 4, 6, 7 and 8 of the compositions as shown in Table 1 below. Each of the molten metals was continuously formed into a thin plate ingot by quenching and solidifying the same by means of an experimental metal quenching and casting facility provided with double rolls of copper which are capable of being water-cooled internally, each roller having its diameter of 400 mm and its width of 100 mm. The conditions for manufacturing the thin plate ingot were as follows:

(1) the number of revolution of the cooling rollers was set to be 50 rpm (the peripheral speed of the rollers being approx. 60 m/min.);

(2) the pouring temperature of the melt onto the cooling rollers were made approx. 50° C. higher than the melting point of each sample alloy; and (3) the space gap between the cooling rollers was set at 1.0 mm. The resulted thin plate ingot had its thickness of 2.0 mm and width of 100 mm.

Since this ingot is made by continuous quenching and solidifying of the molten metal at a cooling rate within the predetermined range, which is higher than in the case of the conventional continuous casting method and batch type casting method, the intermetallic compound of Ni-P and Ni-Si is brought to a state of its being finely and uniformly dispersed in the matrix.

Each of these various ingots was subjected to cold-working, at a single step, into a thin plate having its thickness of 0.4 mm at a working ratio of 80%, without being subjected to homogenize-annealing, then it was subjected to the solution-annealing at 800° C., followed by the aging treatment for two hours at 450° C., and finally it was finished to a plate thickness of 0.25 mm at a cold-rolling ratio of about 37%, thereby preparing a specimen for measuring various properties thereof.

Table 1 below indicates the measured results of each of the above-mentioned specimens along with those of the comparative specimens. From these measured results, it is apparent that the alloy of the present invention has attained remarkable improvement in its shapability in comparison with the alloy produced by the conventional horizontal continuous casting method of low cooling rate, while its tensile strength and electrical conductivity are not so conspicuous.

The shapability of the alloy was evaluated in accordance with the Japanese Industrial Standard (JIS-B7778), wherein the thin plate sample of alloy was bent into a V-shape by an angle of 90 degrees by the V-block method to find out a limit bending radius R of the thin plate, at which it could be bent without causing cracks therein, and then this limit bending radius R is divided by the plate thickness t of the specimen for the value (R/t) of its shapability. The smaller the value of (R/t) is, the superior becomes the shapability of the thin plate. For example, in the comparison of the specimens Nos. 1 and 2, the specimens Nos. 3 and 4, and specimens Nos. 5 and 6, which are closer in composition, the alloy obtained by the method of the present invention has a smaller value of (R/t) than that obtained by the conventional method, a decrease of about $\frac{1}{3}$ from the conventional method being seen in parallel with the rolling direction, and a decrease of about $\frac{1}{4}$ being seen in the vertical direction.

The solder heat-resistance tends to be deteriorated as the contents of Ni, P and Si in the alloy increase. This is due to increase in the quantity of dispersion and deposition of the intermetallic compound of Ni-P and Ni-Si, its size, dispersed state, and so forth. With the alloy obtained by the process of the present invention, since the intermetallic compound is very fine and dispersed uniformly, the alloy obtained by the process of the present invention is about 10% longer in its solder peeling time than that of the comparative alloy, from the comparison, for example, between the specimen No. 6 (present invention) and the specimen No. 5 (comparative example), which are substantially same in composition, hence the former is excellent in its reliability of the solder heat-resistance. The specimen No. 7 further contains a small amount of Zn for the purpose of improving the solder heat-resistance, which reveals further extension by about 50% of the solder peeling time in comparison with the specimen No. 6 according to the process of the present invention, which does not contain Zn. It was further recognized that, with the specimen No. 8 containing therein 0.82% of Zn, the stress corrosion sensitivity of the alloy became increased, hence the upper limit of the Zn content being naturally limited, and that, as the result of the additional experiment, deterioration became conspicuous when the Zn content exceeded 0.5%. By the way, the solder heat-resistance was evaluated in the manner, in which the specimen was immersed into a molten solder bath composed of 90%Pb-10%Sn to subject it to the solder-plating, and then the specimen was heated to 150° C. and held at that temperature level, followed by contact-bending of the solder-plated portion to measure the time until the peeling occurs. On the other hand, the stress corrosion sensitivity was evaluated in accordance with the "CES-A" method as defined by Communication Equipment Industrial Standard (CES), wherein 12.5% by volume of aqueous solution of ammonium was placed on the bottom of the desiccator, and then the bending stress of 30 kgf/mm$^2$ was imparted to the specimen in this atmospheric gas to measure the time until the specimen became broken.

TABLE 1

| Specimen | Composition (% by weight) Ni | P | Si | Zn | Cu | Tensile strength (kgf/mm$^2$) | Electrical conductivity (% IACS) |
|---|---|---|---|---|---|---|---|
| 1 | 1.50 | 0.19 | 0.11 | — | Remainder | 62.6 | 64.6 |
| 2 | 1.48 | 0.19 | 0.12 | — | Remainder | 65.7 | 65.3 |
| 3 | 2.41 | 0.17 | 0.39 | — | Remainder | 72.3 | 44.9 |
| 4 | 2.35 | 0.16 | 0.40 | — | Remainder | 76.3 | 45.3 |
| 5 | 3.95 | 0.16 | 0.70 | — | Remainder | 80.3 | 41.0 |
| 6 | 3.83 | 0.21 | 0.72 | — | Remainder | 83.8 | 42.1 |
| 7 | 3.91 | 0.20 | 0.73 | 0.20 | Remainder | 84.1 | 42.0 |
| 8 | 3.80 | 0.19 | 0.71 | 0.82 | Remainder | 83.9 | 41.9 |

| Specimen | Formability (R/t) Parallel direction | Vertical direction | Solder heat-resistance (hrs) | Stress corrosion sensitivity (hrs) | Cooling rate (°C./sec) | Remarks |
|---|---|---|---|---|---|---|
| 1 | 1.2 | 2.4 | 500 or longer | 400 or longer | 10 | Comparative Example |
| 2 | 0.4 | 0.6 | 500 or longer | 400 or longer | $2.0 \times 10^3$ | Inventive Example |
| 3 | 2.0 | 3.2 | 370 | 400 or longer | 10 | Comparative Example |
| 4 | 0.6 | 0.8 | 420 | 400 or longer | $1.7 \times 10^3$ | Inventive Example |
| 5 | 2.4 | 4.5 | 290 | 400 or longer | 10 | Comparative Example |
| 6 | 0.8 | 1.1 | 320 | 400 or longer | $1.5 \times 10^3$ | Inventive Example |
| 7 | 0.8 | 1.0 | 490 | 400 or longer | $1.5 \times 10^3$ | Inventive Example |
| 8 | 0.8 | 1.0 | 500 or longer | 250 | 10 | Comparative Example |

According to the process of the present invention, the Cu-Ni-P-Si alloy or the Cu-Ni-P-Si-Zn alloy is produced by quenching and solidifying a molten metal at a definite cooling rate, and then continuously cooling in succession the quenched molten metal to a normal temperature. On account of this, there can be obtained the copper alloy for the electronic apparatuses and appliances, in which the intermetallic compound of Ni-P and Ni-Si is dispersed finely and uniformly in the matrix, having remarkably good shapability, and having high reliability in respect of the solder heat-resistance, etc.

By the way, the present invention deals with only the alloy of a type, in which the intermetallic compound of Ni-P and Ni-Si is dispersed in the matrix. It goes without saying, however, that the invention is also appliable to other types of alloy such as copper-based alloys and iron-based alloys, in which the intermetallic compounds of Ti-Ni, Ti-Fe, Mg-P, Cu-Zr, etc. are dispersed.

While, in the foregoing, the present invention has been described with particular reference to its preferred example, it should be understood that the invention is not limited to this example alone, but any changes and modifications may be made to the process conditions, etc. by those persons skilled in the art without departing from the spirit and scope of the invention as recited in the appended claims.

What is claimed is:

1. A method for producing a copper alloy, which comprises steps of: quenching to solidify, at a cooling rate in the range from $10^{2}$° C./sec. to $10^{5}$° C./sec., a molten metal consisting essentially of 1.0 to 8% by weight of Ni, 0.1 to 0.8% by weight of P, 0.06 to 1.0% by weight of Si, and a remainder of Cu and unavoidable impurities; and continuously cooling in succession said solidified metal to normal temperature to cause an intermetallic compound of Ni-P and Ni-Si to be finely and uniformly dispersed into the matrix material.

2. A method according to claim 1, wherein said molten metal further contains 0.03 to 0.5% by weight of Zn.

3. A method according to claim 1, wherein the weight ratio of Ni/P in said molten metal is 5/1, and the weight ratio of Ni/Si therein is 4/1.

4. A method according to claim 1, wherein said intermetallic compound is $Ni_5P_2$ and $Ni_2Si$.

5. A method according to claim 2, wherein the weight ratio of Ni/P in said molten metal is 5/1, and the weight ratio of Ni/Si therein is 4/1.

6. A method according to claim 2, wherein said intermetallic compound is $Ni_5P_2$ and $Ni_2Si$.

* * * * *